US006726054B2

(12) United States Patent
Fagen et al.

(10) Patent No.: US 6,726,054 B2
(45) Date of Patent: Apr. 27, 2004

(54) DISPENSER PACKAGE ARRANGEMENT AND METHODS

(75) Inventors: Constance L. Fagen, Mendota Heights, MN (US); Steven Blake Fisher, South St. Paul, MN (US)

(73) Assignee: Tapemark, Saint Paul, MN (US)

( * ) Notice: Subject to any disclaimer, the term of this patent is extended or adjusted under 35 U.S.C. 154(b) by 0 days.

(21) Appl. No.: 10/112,218

(22) Filed: Mar. 29, 2002

(65) Prior Publication Data

US 2003/0183643 A1 Oct. 2, 2003

(51) Int. Cl.[7] ..... A47K 10/24
(52) U.S. Cl. ..... 221/45; 206/449
(58) Field of Search ..... 221/25, 26, 33, 221/45, 46, 63, 303; 206/461, 449, 532, 494

(56) References Cited

U.S. PATENT DOCUMENTS 3,635,567 A * 1/1972 Richardson, Jr. ..... 401/132
3,869,333 A 3/1975 McMaster
3,884,443 A 5/1975 McMaster
5,067,611 A * 11/1991 Hagmann et al. ..... 206/383
D423,302 S 4/2000 Haner et al.

OTHER PUBLICATIONS

Two (2) Samples: "Cool Mint Listerine PocketPaks™ (16 Strip Pack)", U.S. patent No. Des. 423,302, *Pfizer Consumer Helathcare*, Morris Plains, NJ (©2001).
Two (2) Samples: "Cool Mint Listerine PocketPaks™ (24 Strip Pack)", U.S. patent No. Des. 423,302, *Pfizer Consumer Helathcare*, Morris Plains, NJ (©2001).

* cited by examiner

*Primary Examiner*—Kenneth W. Noland
(74) *Attorney, Agent, or Firm*—Merchant & Gould P.C.

(57) ABSTRACT

A package arrangement is provided. The package arrangement in general includes a blister pack having a backing construction secured thereto. In preferred arrangements, a removable header is provided. The backing construction preferably includes a flexible film having resealable pressure sensitive adhesive on a side thereof, by which the backing portion is secured to the blister pack. A portion of the backing construction is formed as a hinged cover portion, by two cuts, preferably parallel, extending through the backing construction portion and overlapping a selected section of the blister pack. In a preferred arrangement, each cut terminates at a stop structure.

19 Claims, 5 Drawing Sheets

DISPENSER PACKAGE ARRANGEMENT AND METHODS

FIELD OF THE INVENTION

The present disclosure concerns dispenser packages. The packages are primarily for products that come in a sheet or film form. The disclosure particularly concerns disposable packages which can be repeatedly opened and closed, during use, as individual sheets or films are dispensed. A particular application is in the area of packages for breath films.

BACKGROUND OF THE INVENTION

For film or sheet products, such as breath films or other oral care strips, the product packaging preferably serves numerous purposes including:

1. securely containing and protecting the product during shipping and handling;
2. displaying the product at the point of purchase;
3. containing and protecting unused product during repeated opening and closing, i.e., as individual films are dispensed and used;
4. convenient fit in a pocket or purse; and
5. tamper evidence indication.

One example of current oral care strip product available on the market is the "Cool Mint Listerine PocketPaks" product available from Warner-Lambert Consumer Health Care, Morris Plains, N.J. The product packaging for this product involves a cardboard or paperboard slipcover (about 3 and ⅝ inches by about 3 inches) having enclosed therein and removable there from, another cardboard or paperboard piece (about 3 and ⅜ inches by about 2 and 15/16 inches) having a blister pack attached thereto. After the second piece is removed from the slipcover, it is torn open by removal of a panel (about 1 and 5/16 inches by about 1 and ⅞ inches) in the cardboard or paperboard packing. Underneath the removable panel, a barrier film or metallized sheet is encountered which, once torn open or removed, allows access to inside of the blister pack. Contained within the blister pack is a plastic dispenser (about 1 and ⅛ inches by about 1 and ⅞ inches) which can be removed. The remainder of the package is discarded. The dispenser has a hinged panel selectively opened (and reclosed) with a tab, that allows access to internally received oral care strips.

In general, improvement in such packaging is desirable.

SUMMARY

According to the present disclosure a package arrangement is provided which includes a receptacle and backing construction. In general the receptacle has an outer peripheral rim thereon, and the backing construction comprises a flexible film having releasable pressure sensitive adhesive on a first side thereof. In general, the backing construction is secured to the receptacle, by contact between the pressure sensitive adhesive in the outer peripheral rim. Products such as sheet materials are typically stored within the receptacle, and are covered by the backing construction.

The backing construction includes an openable and recloseable hinge cover portion therein. The hinge cover portion is generally formed by cuts or die cuts through the flexible film. The die cuts are generally parallel to one another in preferred embodiments, to form a flexible openable and recloseable cover in the backing construction. In preferred embodiments the cuts terminate in curved stops, to facilitate the opening/closing operation without undesirable tearing of the hinge cover portion from a remainder of the backing construction.

In a preferred embodiment a removable reinforced header portion is provided in the packet, which header portion is typically torn from the remainder of the package prior to opening of the package. Inp preferred arrangements, the header portion comprises a relatively rigid piece of cardboard or plastic, secured to a portion of the backing construction. In some embodiments a tamper evident strip is positioned between the header and the outer peripheral rim on the receptacle, to provide security.

According to the present disclosure a method is provided of dispensing articles from a package. In general the method involves opening and reclosing a package generally as characterized above.

Also according to the disclosure methods of assembly are provided, generally involving assembling the parts characterized above, in a preferred and operational manner.

BRIEF DESCRIPTION OF THE DRAWINGS

FIG. 3 being depicted after a step of removal of a header portion from remainder of the package arrangement.

FIG. 6 depicting the arrangement completely open and during a step of removal of a sheet product from an interior reservoir:

DETAILED DESCRIPTION

Figure 1:
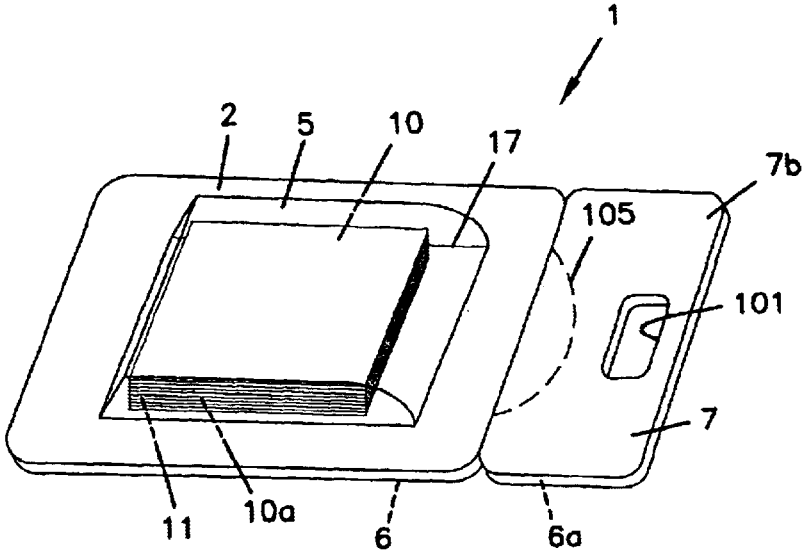
FIG. 1 is a front prospective view of a package arrangement according to the present disclosure; the arrangement of FIG. 1 being depicted with a plurality of dispensable sheet products therein, and with a removable header portion attached to the packaging arrangement.

I. General Features of Preferred Packaging Arrangements

In general, the present disclosure concerns a package arrangement for storing, handling and dispensing sheet materials (such as water soluble breath films or other edible films) normally dispensed in a sheet form. Of course other products can be continued in the package, but it is designed to be particularly convenient for such materials.

Packaging for such materials is provided in a "pocket/purse size", i.e., a size that can be conveniently fit in a pocket, purse or similar space. Typically and preferably such arrangements have a size of no larger than about 2 inches by 4 inches, and a depth of no greater than about 0.75 inch. Typical preferred sizes of the packaging, after purchase and after removed of any discardable header, i.e., when stored in the pocket, is a size no greater than about 2 inches by about 2.75 inches. More preferably the depth of the packaging is no greater than about 0.40 inches.

Preferred packaging features according to the present disclosure provide the following:

1. A container volume preferably generated by a clear or transparent plastic film thermoformed or vacuum formed into a reservoir (for example, a blister pack) for containing sheet product to be dispensed;
2. A flexible hinged member for repeated opening and closing of the reservoir volume, for access to individual sheet items to be dispensed, during product use; and,
3. A conveniently removable header attachment for use in storage and display at a store location, but which upon removal reduces the size of the package for handling and use.

In many applications, preferably a tamper evident sealing is provided, since the products to be dispensed are, often,; intended to be ingested. Also, in many applications it is preferred that the material chosen for the packaging be such as to ensure proper protection of the internally received product(s) with respect to shelf life, for example low moisture vapor transmission.

In the drawings, described in detail below, a particular arrangement which accomplishes all of the above preferred features is provided. It is noted that unless specifically otherwise characterized, there is no requirement that all of the advantageous features feasible with the techniques described herein must be implemented in all products constructed in accord with the general principles provided herein.

II. A Preferred Package Arrangement

Figure 5:
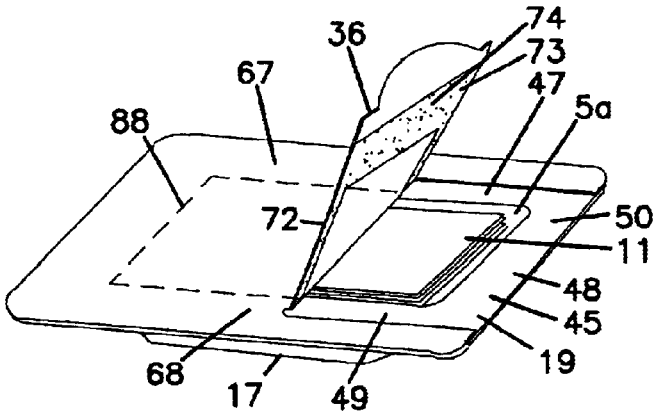
FIG. 5 is a bottom prospective view of the arrangement depicted in FIG. 4; the package arrangement in FIG. 5 being shown completely opened.
Figure 6:
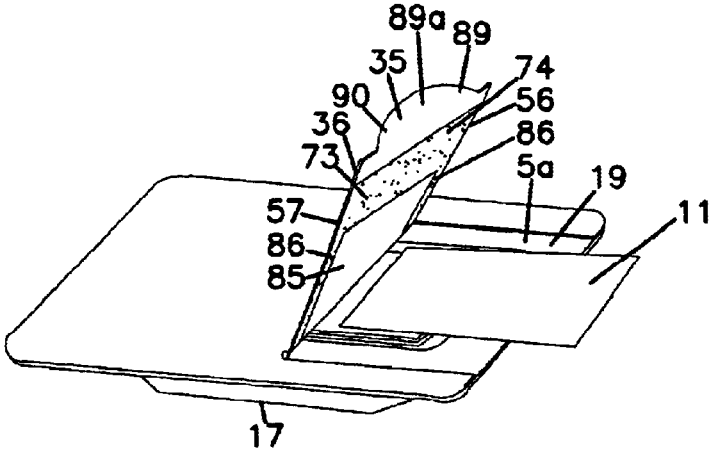
FIG. 6 is a bottom prospective view of the arrangement shown in FIGS. 4 and 5.
Figure 7:
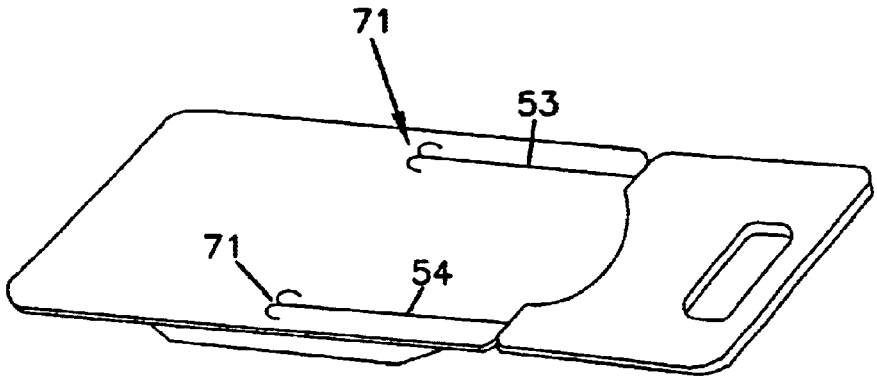
FIG. 7 is a bottom prospective view of a first alternate embodiment of a package arrangement according to the present disclosure.
Figure 8:
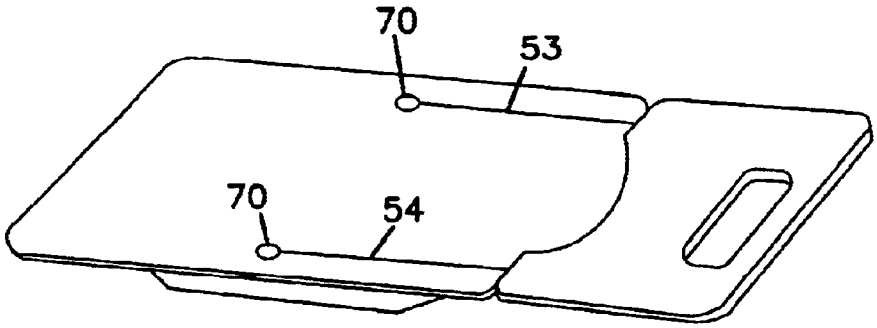
FIG. 8 is a bottom prospective view of a second alternate embodiment of a package arrangement according to the present disclosure.
Figure 9:
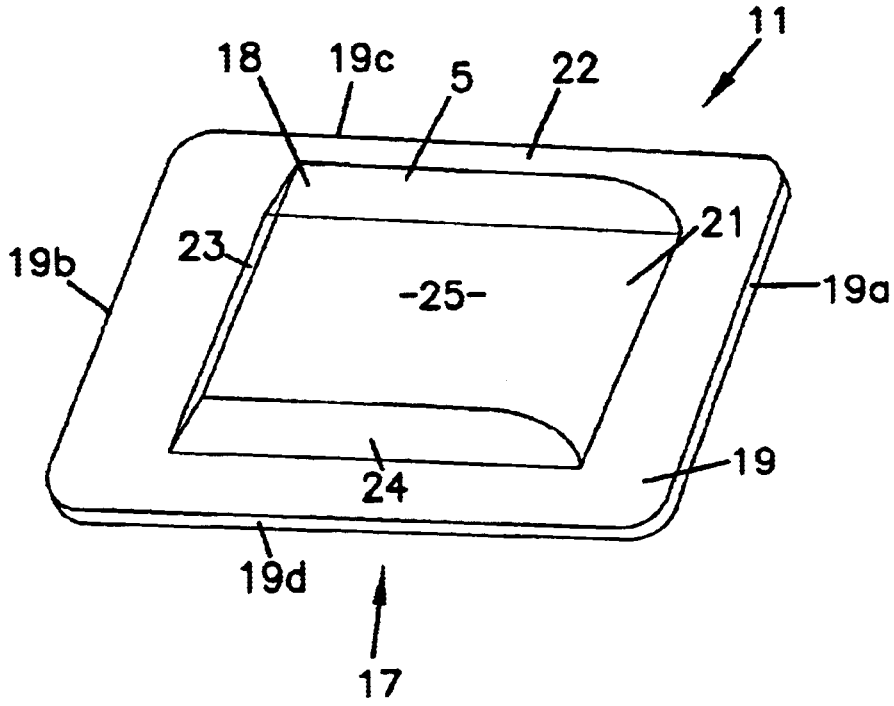
FIG. 9 is a top plan view of a component of a package arrangement according to FIG. 1.
Figure 10:
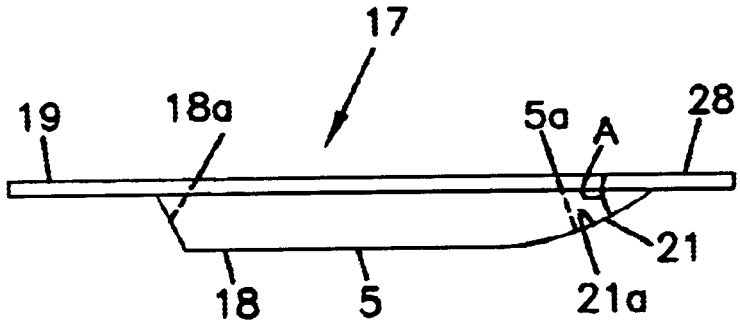
FIG. 10 is a side elevational view of the component depicted in FIG. 9.
Figure 11:
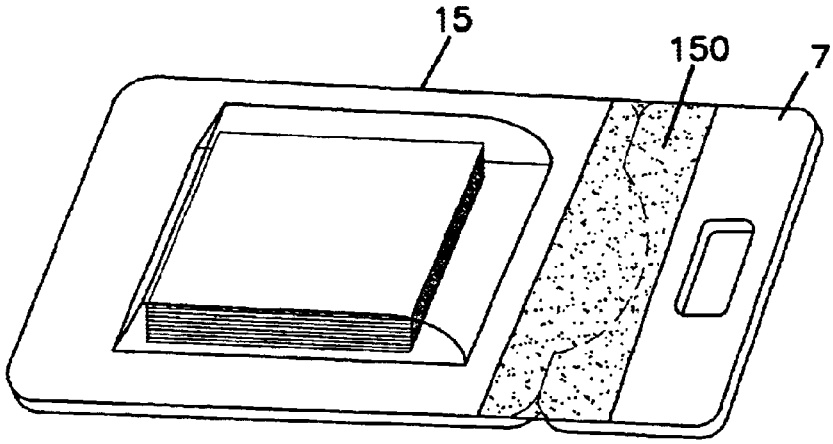
FIG. 11 is a top plan view of the arrangement shown in FIG. 1, depicting the presence thereon of a tamper evident seal strip.
Figure 12:
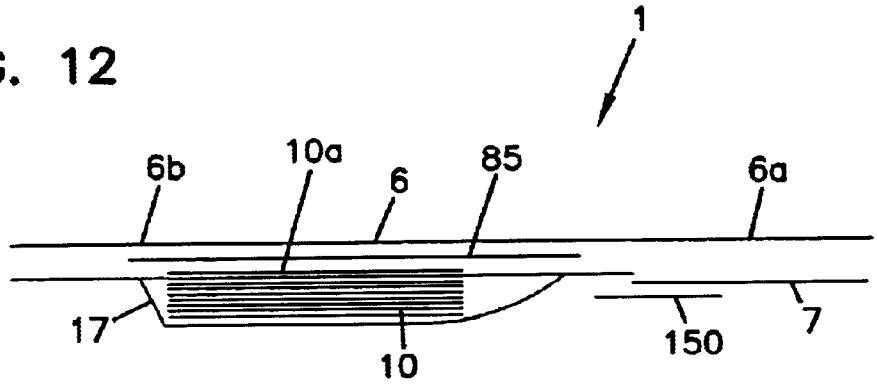
FIG. 12 is an exploded schematic, side view of the arrangement depicted in FIG. 1; the arrangement of FIG. 12 depicting general components and their relation to one another with respect to assembly.

FIGS. 1–6 depict a preferred package arrangement embodying principles according to the present disclosure, and including preferred features as characterized above. In FIGS. 7 and 8, various alternative embodiments are depicted. In FIGS. 9 and 10, a reservoir component is depicted. In FIG. 11, an optional tamper evident seal strip is shown. In FIG. 12, a schematic depicting relative component positions is provided.

Referring to FIG. 1, reference numeral 1 generally designates a package arrangement according to the present invention. In FIG. 1, a front side 2 (perspective view) is depicted of the package arrangement 1. In general, the package arrangement 1 includes: reservoir or receptacle 5; backing construction 6; and, header 7. (The backing construction 6 covers a backside 3, not viewable in FIG. 1; see FIG. 2).

Figure 3:
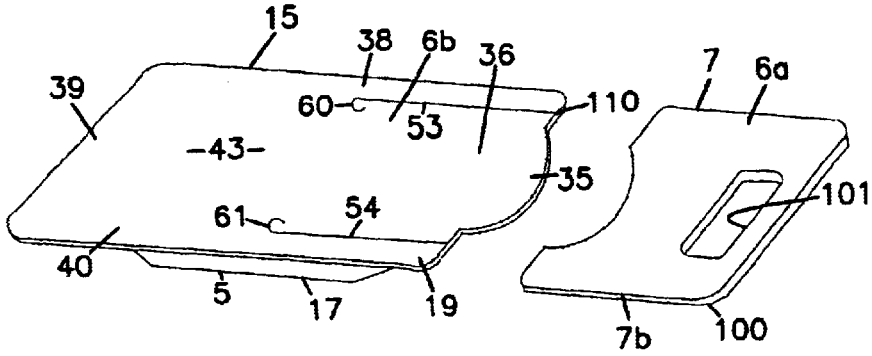
FIG. 3 is a bottom prospective view of the arrangement depicted in FIG. 2.

In the particular arrangement 1 depicted, the header 7 is a removable header piece that, after purchase and before the package 1 is to be stored in a purse or pocket, is torn or separated from the remainder of the package 15, FIG. 3, and is discarded; thus reducing the size of package arrangement 1 to the size of package 15. This is described in greater detail below, in connection with other drawings.

The particular package arrangement depicted in FIG. 1, is an arrangement including a stack 10 of sheet products 10*a*, for example breath films 1, contained therein. After the consumer has purchased package arrangement 1, and discarded the header 7, the resulting package arrangement 15, FIG. 3, is still sealed closed. The resulting package arrangement 15 is generally simply package arrangement 1 with the header 7 removed. The header 7, FIGS. 2 and 3, generally comprises a two piece or composite construction comprising a portion 6A of backing construction 6 and reinforcement piece 7B.

Figure 4:
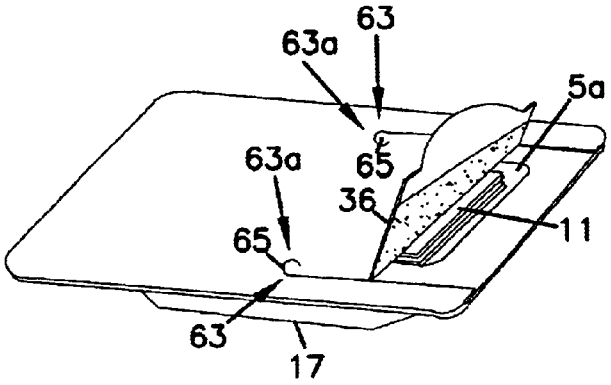
FIG. 4 is a bottom prospective view of a package arrangement according to FIGS. 1–3 with a header portion removed; the package arrangement in FIG. 4 being depicted partially open.

The backing 6 is preferably constructed in a manner such that a portion 6B of it, FIG. 3, can be repeatedly opened and closed, to allow access to an interior 5A (FIGS. 4–6) of reservoir or receptacle 5 of package 15, for access to individual ones of films 11. After an individual film 11 is removed from the package 15, the backing construction portion 6B can then be reclosed. The opening of package 15 is shown in FIGS. 4 to 6. Closing would be the opposite.

A. The Reservoir or Receptacle 5

Of course, the reservoir or receptacle 5 can be formed from a variety of materials. It is anticipated that for a typical preferred application, the receptacle 5 will comprise a thermoformed or vacuum formed plastic material, and can be made as a "blister pack" construction 17 (FIGS. 9 and 10) using known techniques for blister packs applied to form a selected, preferred, shape. In general, a variety of shapes can be chosen. The material used in the vacuum forming can, if desired, be selected to provide for a clear or transparent receptacle so that the stack 10 can be viewed by the customer, FIG. 1, before purchase. It is anticipated that a typical blister pack 17 will comprise a PETG or APET material about 7 to 15 mils thick for MVTR (moisture vapor transmission) control, and which has been vacuum formed using conventional techniques, with heat.

Referring to FIGS. 9 and 10, in which the component comprising the receptacle 5 is depicted, the receptacle 5 preferably comprises a blister pack 17 defining: a bowl, dispenser or receiver 18 defining interior 18A and, an outer rim 19. The particular, preferred bowl 18 depicted has a sloped, slanted or slightly concave front end 21. The term "front end" as used in this context, is meant to refer to a sidewall 21 over which individual films 11 are typically dispensed, as they are removed from the bowl interior 18A in normal use. The slanted front end wall 21 facilitates ease of removal of the individual films 11, since they can be slid or directed upwardly and outwardly by the slanted wall 21. An approximate (not precise because the wall 21 is curved) internal angle A of wall 21 relative to rim 19, shown in FIG. 10, on the order of 25° to 45° will be typical. The term "internal angle" in this context is meant to refer to the angle between a plane approximating an interior surface 21A of front wall 21 and a plane of rim 19, as shown at A in FIG. 10.

Other features of the blister pack 17 will generally be selected to be convenient and inexpensive for manufacture, and to allow for ease of stacking, packing and handling. The particular arrangement shown, the blister pack reservoir interior 18A, FIG. 10, is defined (FIG. 9) by four outside walls 21, 22, 23 and 24, and a front or base wall portion 25, formed in the thermoform process. As indicated, the blister pack 17 also preferably includes a rim area 19 which preferably has a flat, planar peripheral area 27 on one side 28, FIG. 10, onto, and against, which the backing construction 6 (FIG. 2) is secured in use. In general, the side 28 to which the backing construction 6 is secured, is a side of rim 19 directed away from a direction of projection of the reservoir 18.

In general, the rim area 19, FIG. 9, defines front edge 19A, a rear edge 19B and first and second opposite side edges 19C and 19D. The front edge 19A will generally be the edge adjacent front end 21; and, the rear edge 19B will generally be an opposite edge, with edges 19C and 19D extending there between. In the particular embodiment shown, the rim 19 generally defines an outer peripheral shape or footprint which is generally rectangular; i.e., edges 19A and 19B are generally parallel to one another; edges 19C and 19D are generally parallel to one another; and edges 19A and 19B generally extend perpendicularly to edges 19C and 19D. One manner in which the 19 differs from being perfectly rectangular, is that the corners are rounded. Herein, however, even when rounded corners for the rim 19 as shown in FIG. 9 are present, the shape will be generally characterized as "rectangular."

B. The Backing Construction 6

Figure 2:
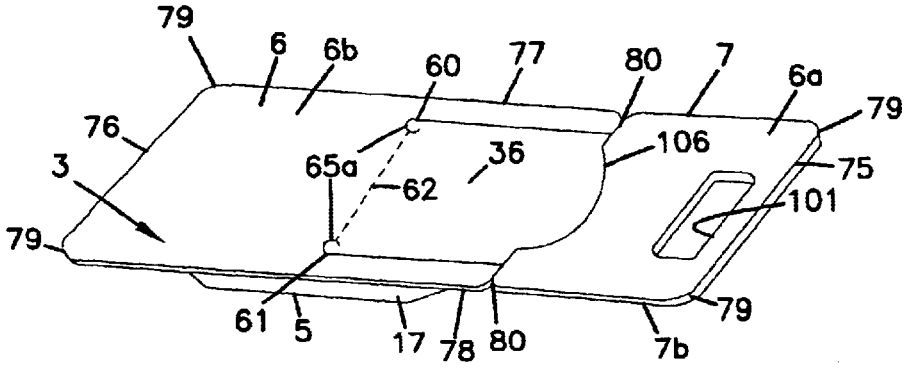
FIG. 2 is a bottom prospective view of the arrangement depicted in FIG. 1.

In general, as indicated above, the backing construction 6 includes two portions 6A and 6B, FIG. 2. Portion 6A generally forms a portion of the header 7, and is removed from the package arrangement 1 in normal operation, FIG. 3. Backing construction portion 6B generally remains with the package 15 after removal of the header 7, FIG. 3, and includes features that provide for the following:

1. secure closure of receptacle 5;
2. easy opening of receptacle 5, for access to enclosed sheets or films 11; and
3. convenient reclosure of receptacle 5 after one or more sheets or films 11 have been removed.

In typical embodiments, the backing construction 6 will generally comprise a strong flexible film having one side completely coated with a pressure sensitive adhesive (PSA). Preferably a resealable PSA is used, so that portions can be stripped away from blister pack 18 during opening and then be securely reclosed, conveniently. Typically the material for backing construction 6 is purchased from a supplier of resealable films, i.e., as a film having PSA already provided thereon. Usable materials include, for example: Flexicon optiflex PP200 H clear TC-332 EXV-133 TRACrite 100, a polydefin available from Flexcon, Spencer, Mass. is desired (covered by a holographic material such as Avery Dennison 95902 2.6M WH BOPP TC/R195/40#SCK). However, any other recloseable PSA that is a direct or indirect food grade material that reseals up to 40 times without adhesive residue can be used.

To provide for preferred operation, FIG. 3, the preferred backing construction portion 6B is configured and positioned to provide the following structural features: tab 35; hinged cover portion 36; perimeter portions 38, 39 and 40; and central portion 43.

Preferably, perimeter portions 38, 39 and 40 include exposed pressure sensitive adhesive (PSA) coating on the side toward the blister pack 17 to secure the backing construction portion 6B in package 15, more specifically to rim 19 of blister pack 17. The term "exposed" in this context, is meant to refer to a portion of the pressure sensitive adhesive field which directly contacts, and thus provides resealable adherence to, the blister pack 17. This would be by contrast to a "covered" area of pressure sensitive adhesive, as described below, which is permanently covered up by some material and thus is prevented from contacting certain structure.

Preferably, the exposed pressure sensitive adhesive in perimeter portions 38, 39 and 40 and the size of portions 38, 39, 40 is selected to engage rim 19 while leaving inner border area 45, FIG. 5, of rim 19 uncovered by perimeter portions 38, 39 and 40. Most preferably border area 45 of rim 19 is defined by three segments comprising segments 47, 48 and 49. In general, segment 48 extends between segments 47 and 49 to define a U-shaped section 50 in rim 19. In general U-shaped section 50 is a portion of rim 19 which is selectively covered by, and uncovered by, hinged cover portion 36 during typical use.

Another important feature of hinged cover portion 36 is cuts 53, 54, FIG. 3. The cuts 53, 54 are die cuts through backing portion 6B to form opposite side edges 56, 57 of hinged cover portion 36, FIG. 6. Cuts 53, 54 terminate at ends 60, 61, FIG. 3. During use, tab 35 is grabbed and hinged portion 36 is stripped away from receptacle 5, until ends 60, 61 of cuts 53, 54, respectively, are reached, FIGS. 3–6. As a result, a living hinge is formed, along line 62, FIG. 2, between ends 60, 61 in the flexible material of backing construction portion 6B, to form hinged cover portion 36. In general, then, cuts 53, 54 define backing construction portion 6B and perimeter portions 38 and 40. Preferably cuts 53, 54 are parallel to one another.

Preferably ends 60, 61 each include a tear stop 63 there at, FIG. 4. For the particular embodiment shown in FIGS. 1–6, each tear stop 63 comprises a curved stop 63A. The particular curved stops shown comprise curved cuts formed as a hook 65 at an inside end (end away from front edge 19A, FIG. 9) of each cut 53, 54 to help prevent the user from completely stripping the hinged cover portion 36 from package 15 when tab 35 is grabbed, and the package 15 is opened, FIGS. 4–6. That is, the hooks 65 generally create curved stops so that the hinged cover portion 36 does not continue to tear in regions 67 and 68, FIG. 5, under ordinary pressure of lifting on tab 35. For the particular embodiment shown, the hooks 65 are each "inwardly directed" hooks 65*a*, FIG. 2. That is, each hook is curved in a direction pointing toward the other hook, as shown. In alternate arrangements, for example, outwardly directed hooks, could be used.

In a typical embodiment for an oral care strip, the length of cuts 53, 54, prior to the curved end stops 63, FIG. 3, is about 0.75–1.25 inches, typically about 1 inch. A typically usable radius for the curve of hooks 65 is about 0.061 inches.

Still further alternate configurations of curved stops, as tear stops 63, are usable. Two such alternate arrangements are shown in FIGS. 7 and 8. The arrangement in FIG. 7 shows a double hook 71 (both inwardly and outwardly directed hooks) die cut at the end of the cuts 53, 54. The arrangement of FIG. 8, shows a circle die cut 70 at the end of one of cuts 53, 54. Still other ways of forming stops could include providing a region of no adhesive at the end of each cut 53, 54. The three curved stop variations shown in FIGS. 2, 7 and 8, allow for a convenient stops while using a system in which the backing construction 6 comprises a film as described above, completely covered on one side with pressure sensitive adhesive, as opposed to requiring a special adhesive pattern.

As indicated above, a typical preferred backing construction 6, FIG. 5, will generally include two components:

(a) a substrate or film 72; and (b) a resealable pressure sensitive adhesive field 73 completely covering one side 74 of the substrate 72.

In general, the preferred substrate/PSA combination used will be shaped in the form of the entire outline or footprint of the backing construction 6. In general the "outline" or "footprint" of the backing construction 6 will sometimes be referred to herein as the "peripheral definition" of the package arrangement 1. The peripheral definition for the arrangement 1 depicted in the drawings, FIG. 2, is generally rectangular, i.e., with opposite end edges 75, 76 and opposite side edges 77, 78. The arrangement differs from perfectly rectangular in two ways: first, the corners 79 are rounded; and secondly, first and second opposite edge V-shaped notches 80 are provided in sides 77, 78. Herein, a peripheral outline or definition for the backing construction 6 such as that indicated in the drawings, will be referred to as "rectangular" or "generally rectangular," in spite of such rounded corners and edge notches, as long as the shape is substantially defined by: a first pair of opposite end parallel edges; and a second pair of opposite, parallel, edges; with the first pair perpendicular to the second pair.

Herein the notches 80 are referred to as V-shaped notches, despite the fact that for the preferred embodiment depicted they comprise two curves joined at a vertex, each being convex relative to the other. In general they each do define a V-shape, and facilitate tearing of the header piece 7 form the remainder of the arrangement 1, FIG. 1.

A deadening pad or film 85, FIG. 6, is used to cover a region of the PSA at which it is desired to have the backing construction 6 not be tacky, i.e., where it is desired that there be no exposed adhesive. In the preferred embodiment shown, a deadening film 75 is preferably positioned on side 74 to overlap the bowl or receptacle 5, with some slight overlap (about 0.030 to 0.090 inches) over rim 19. This would inhibit the PSA from undesirably coming into contact with the articles 11 stored within the receptacle 5, during normal use. Preferably the film 75 leaves regions 86 of exposed PSA adjacent opposite side edges of the deadening film 85, of at least about ⅛ inch, typically about ⅛ to ½ inch wide, on cover portion 36.

In FIG. 5, phantom line 88 depicts where an edge border of the deadening film 75 is located:. In FIG. 5, a portion of the deadening film 85 is viewable, since the hinged cover portion 36 is partly stripped away from rim area 19, and the deadening film 85 is flexible.

In general, the peripheral definition of the preferred deadening film 85, i.e., the shape of the deadening film, merely needs to be such as to conveniently cover the bowl or receptacle 5 and to engage a portion of the rim 19, with adequate overlap. Typical configurations will be rectangular, since typical bowls 5 will be rectangular in definition at the location inside of the rim 19. Of course a variety of alternative shapes are possible.

Attention is now directed to FIG. 6. Tab 35 includes, on side 89, deadening piece 89A. This piece 89A covers a portion of the pressure sensitive adhesive 73, to ensure that side 90 of tab 35 is not tacky to the touch. When the preferred package arrangement 1 is assembled, piece 89A comprises a residual portion of the rigid material used to form header 7. This will be described below, in connection with the detailed description of the header 7.

C. The Header 7

The typical header 7, FIG. 3, generally comprises at least a two piece composite structure including: portion 6A of flexible backing construction 6; and, a rigid deadening piece 100; the two pieces being secured to one another by pressure sensitive adhesive on portion 6A. The deadening piece 100 is secured to side 74 of backing construction portion 6A, in covering relation to the PSA. Preferably piece 100 comprises relatively rigid material suitable for use as a hanger and also in a form that can be readily stripped from a remainder of the package arrangement 1, to leave package 15 behind.

A typical usable material for piece 100 is a 5 to 10 mil cardboard or paperboard tag, or a styrene tag. The material chosen is preferably one that can be printed on one or both sides. The particular header 7 depicted in FIGS. 1–3, includes a hanger member 101 therein, in the form of an aperture, by which the unit can be hung from a peg. Alternate constructions could use hooks or other shapes cut in header piece 7, as a hanger member 101.

Edge notches 80 are located between header piece 100 and front edge 19A of rim 19. The notches 100 facilitate tearing the header 7 from the remainder of the package 15, FIG. 3. To facilitate this tearing:

1. Deadening piece 100 is provided with a line of weakening, for example it is scored, partially die cut, or provided with a perforated line, generally along line 105, FIG. 1 in order to provide a tear line for removal of header 7 from the remainder of the unit, while leaving piece 89A, FIG. 6; and
2. A die cut is provided;along line 106, FIG. 2, through the backing construction 6, in part in overlap to the perforated line, again to facilitate tear of header 7 from the remainder of the package construction 15.

Note that line 106, terminates at opposite side edges 77 and 78, at edge notches 80. Also, the preferred shape of lines 105, 106 is such as to provide for a protruding tab portion 35, in the resulting package 15, after the tearing occurs. Preferably tab 35 projects outwardly from edge 110, FIG. 3, a distance of at least 0.25 inches and preferably a distance of at least 0.3–0.4 inches. Typically a tab with maximum projection of about 0.325 inches should work well.

Attention is now directed to FIG. 11. In FIG. 11 the arrangement 1 is depicted with a tamper evident strip 150 thereon. This strip is secured to an extension between edges 77, 78 over a region between header 7 and a remainder of the package construction 15. Strip 150, preferably secured by a non-releasable adhesive, is used to indicate whether the package construction 1 has been opened, before purchase.

For the tamper resistant seal strip 150 a variety of materials can be used. Typically a permanent pressure sensitive adhesive, as opposed to a resealable adhesive, on a printable label stock will work. The strip material will generally indicate if the package has been opened.

Attention is now directed to FIG. 12. FIG. 12 is a side schematic view, indicating components. In FIG. 12 the following components are readily viewable, in exploded form:

(a) backing construction 6, including region 6A and 6B;
(b) deadening piece 85;
(c) stack 10 of sheets 10A;
(d) header piece 7 (minus backing construction portion 6A);
(e) blister pack 17; and
(f) tamper evident strip 150.

Arrangement 1 can be assembled in a variety of ways, using a variety of methods. The schematic of FIG. 12 indicates how the various components can be brought together, to create the final arrangement. Various high-speed manufacturing methods can be used, including continuous webs cut to form the various portions. In addition, individual pieces can be pre-cut, and be assembled in the manner of FIG. 12.

In general, according to the principals disclosed above, a method of dispensing a sheet product from a package is provided. The method generally includes steps of: stripping open a receptacle by peeling a hinge cover portion having resealable pressure sensitive adhesive thereon, from a peripheral rim portion of the receptacle; removing a sheet product from the receptacle; and reclosing the receptacle by resealing the hinge cover portion to the peripheral rim portion, i.e., with the pressure sensitive adhesive. In general, the step of stripping is limited by a pair of curved stops; and, the step of stripping involves nonremoval of the hinge cover portion from the package. By this latter, it is meant that the hinge cover portion remains attached to the package and is not removed there from, during the stripping step. By the term "limited" in this context, it is meant that the curved stops will stop or limit stripping, if stripping is conducted until they are reached.

Preferred methods involve, prior to the step of stripping, a step of separating the header portion from the remainder of the package. This step preferably involves leaving a reinforced tab on the package, in order to have a strengthened tab that is nontacky, to grab to facilitate opening. In various applications, prior to the step of separating the header portion from remainder of the package, a tamper evident seal strip, between the header portion and the receptacle, is opened. In still other systems, the strip will be opened during the step of removing the header portion from the package.

The above specification provides a complete description of the manufacture and use of the invention. Since many embodiments of the invention can be made without departing from the spirit and scope of the invention, the invention resides in the claims.

What is claimed is:

1. A package arrangement comprising:

(a) a receptacle having an outer peripheral rim thereon; and, (b) a backing construction secured to the outer peripheral rim and in covering relation, to the receptacle;

(i) the backing construction comprising a flexible film having a resealable pressure sensitive adhesive on a first side thereof by which the backing portion is secured to the outer peripheral rim; and (ii) the backing construction including an openable and reclosable hinged cover portion therein; said hinged cover portion comprising a portion bordered along opposite side edges by cuts through the flexible film of the backing construction.

2. A package arrangement according to claim 1 including:

(a) a removable reinforced header portion comprising a rigid piece secured to said flexible film of said backing construction, in extension beyond a front edge of said outer peripheral rim.

3. A package arrangement according to claim 2 wherein:

(a) said rigid piece of said header is secured to pressure sensitive adhesive on said first side of said flexible film.

4. A package arrangement according to claim 3 including:

(a) a flexible deadening film secured to said first side of said flexible film of said backing construction in covering relation to said receptacle.

5. A package arrangement according to claim 4 wherein:

(a) said backing construction is rectangular.

6. A package arrangement according to claim 5 wherein:

(a) said backing construction includes opposite side edges each of which includes a v-notch therein positioned between said outer peripheral rim and said header.

7. A package arrangement according to claim 6 wherein:

(a) said first and second cuts in said backing construction each terminate in a curved stop.

8. A package arrangement according to claim 7 wherein:

(a) each curved stop includes at least one hook.

9. A package arrangement according to claim 7 wherein:

(a) each curved stop comprises a circle.

10. A package arrangement according to claim 7 wherein:

(a) prior to removal of said header, said backing construction has a perimeter definition no greater than 2 inches by 4 inches.

11. A package arrangement according to claim 10 wherein: (a) after removal of said header, said remaining portion of said backing construction has a perimeter area no greater than 2 inches by 3.25 inches.

12. A package arrangement according to claim 11 wherein:

(a) after removal of said header, the remaining package includes a tab projecting peripherally beyond a front edge of said outer peripheral rim;

(i) said tab comprising a portion of said flexible film of said backing construction including a deadening, reinforcing, piece secured to said first side by pressure sensitive adhesive.

13. A package arrangement according to claim 12 wherein:

(a) said deadening, reinforcing piece of said tab comprises a section of said rigid piece secured to said flexible film, to form said header portion, which separates from a remainder of said rigid piece, when said header portion is removed from said package arrangement.

14. A package arrangement according to claim 13 wherein:

(a) said rigid piece, secured to said flexible film to form said header portion, includes a line of weakening therein, to facilitate breaking a first portion from said header portion, to form said tab.

15. A package according to claim 13 including:

(a) a tamper evident seal strip secured in position over a joint between said header portion and said outer peripheral rim on said receptacle.

16. A method of dispensing a sheet product from a package; said method including steps of:

(a) stripping open a receptacle by peeling a hinged cover portion having resealable pressure sensitive adhesive thereon, from a peripheral rim portion on said receptacle;

(i) said step of stripping being limited by a pair of curved stops;

(ii) said step of stripping involving non-removal of the hinged cover portion from the package;

(b) removing a sheet product from the receptacle; and (c) reclosing the receptacle by resealing the hinged cover portion to the peripheral rim portion with the pressure sensitive adhesive.

17. A method according to claim 16 including:

(a) prior to conducting said step of stripping a first time, a step of separating a header portion from a remainder of the package is conducted.

18. A method according to claim 17 wherein:

(a) said step of separating a header portion from a remainder of the package includes leaving a reinforced tab on the package.

19. A method according to claim 18 wherein:

(a) prior to, or simultaneously with, said step of separating a header portion from a remainder of the package, a tamper evident seal strip, between the header portion and the receptacle, is opened.

* * * * *